US006727641B2

(12) United States Patent
Kakigi

(10) Patent No.: US 6,727,641 B2
(45) Date of Patent: Apr. 27, 2004

(54) FUNNEL FOR CATHODE RAY TUBE

(75) Inventor: Hiroshi Kakigi, Otsu (JP)

(73) Assignee: Nippon Electric Glass Co., Ltd., Shiga-Ken (JP)

( * ) Notice: Subject to any disclaimer, the term of this patent is extended or adjusted under 35 U.S.C. 154(b) by 0 days.

(21) Appl. No.: 10/328,837

(22) Filed: Dec. 24, 2002

(65) Prior Publication Data

US 2003/0132696 A1 Jul. 17, 2003

(30) Foreign Application Priority Data

Dec. 25, 2001 (JP) ..... 2001-391659
Nov. 8, 2002 (JP) ..... 2002-325711

(51) Int. Cl.[7] ..... H01J 31/00; H01J 29/70
(52) U.S. Cl. ..... 313/477 R; 220/2.1 A; 220/2.3 A
(58) Field of Search ..... 313/477 R; 220/2.1 A, 220/2.3 A

(56) References Cited

U.S. PATENT DOCUMENTS 5,929,559 A * 7/1999 Sano et al. ..... 313/477 R
6,002,203 A 12/1999 Yokota et al.
6,495,951 B1 * 12/2002 Kim et al. ..... 313/477 R
6,552,483 B1 * 4/2003 Cho et al. ..... 313/477 R

FOREIGN PATENT DOCUMENTS

| | | |
|---|---|---|
| JP | 11-17355 | 2/1999 |
| JP | 11-120939 | 4/1999 |
| JP | 11-120940 | 4/1999 |
| JP | 11-273591 | 8/1999 |

* cited by examiner

*Primary Examiner*—Ashok Patel
(74) *Attorney, Agent, or Firm*—J.C. Patents

(57) ABSTRACT

A diagonal inner-face curved portion is formed on an inner face of a diagonal portion of a pyramid-shaped yoke portion. The diagonal inner-face curved portion is formed to make at least one of partially inner-face curved portions at the major axis side and the minor axis side of the diagonal axis swell to the outward side. The partially inner-face curved portions at the major axis side and the minor axis side are formed by circular arced portions with different radii to each other.

8 Claims, 5 Drawing Sheets

FUNNEL FOR CATHODE RAY TUBE

CROSS-REFERENCE TO RERATED APPLICATION

This application claims the priority benefit of Japanese application serial No. 2001-391659, filed on Dec. 25, 2001, and 2002-325711, filed on Nov. 8, 2002.

BACKGROUND OF THE INVENTION

1. Field of the Invention

This invention relates in general to an improved technology for a pyramid-shaped yoke portion that is formed to be continuous to a body portion of a funnel for a cathode ray tube (CRT).

2. Description of Related Art

As is well known, a cathode ray tube mainly comprises a panel having a substantially rectangular image display portion and a funnel that is sealed to the panel to allow electron beams to pass therein. The funnel comprises a large opening portion with a substantially rectangular shape, a small opening portion with a substantially circular shape to which a cylindrical neck tube for installing an electron gun therein is connected, a substantially funnel-shaped body portion, and a yoke portion, on which a deflection yoke is externally mounted, being continuous to the body portion at the side of the small opening portion.

In the cathode ray tube with the above elements, because the deflection yoke is a large consuming source of electric power, it is very important to reduce the consumption of electricity of the deflection yoke to save and reduce the total consuming power of the cathode ray tube. To reduce the consuming power of the deflection yoke, an approach is known where the neck tube of the funnel can be shrunk to a small diameter and the outer diameter of the yoke portion on which the deflection yoke is mounted is reduced.

However, because the electron beams, which are emitted from the electron gun inside the neck tube, pass nearby the inner wall of the yoke portion, as the outer diameter of the neck tube or the yoke portion is reduced, the electron beams, which directs toward the diagonal portion that forms a maximum deflection angle, might collide with the inner wall of the yoke portion. As a result, there is a problem that a good image cannot be obtained.

In order to solve such a problem, a pyramid shape, which changes gradually from circular shape to a substantially rectangular shape in the direction from the neck tube side to the panel side, has been practically used. If the outside of the yoke portion is the pyramid shape, the diameters in the major and minor axis directions of the deflection yoke can be reduced, and therefore, the deflection coils corresponding to the major and minor axis directions can approach the electron beams. In this way, the electron beams can be more efficiently deflected, and advantageously, the deflection power can be reduced.

Similarly, in order to keep the electron beams, which directs toward the diagonal portion of the inner diameter of the yoke portion, from colliding with the internal wall thereof, a pyramid shape, which changes gradually from circular shape to a substantially rectangular shape in the direction from the neck tube side to the panel side, has been practically used.

In this situation, for example, referring to Japanese Laid Open No. 11-120940 or No. 11-176355, when the inner face of the yoke portion is formed with a pyramid shape, the diagonal portion is formed with an arc-shaped curved portion in consideration of the moldability or the strength. The curved portions at the major and minor axis sides are circular arc shapes with substantially the same radii with respect to the diagonal axis as a reference. It is usual that the shape of the inner face of the yoke portion is substantially corresponding to an ideal passing area of the electron beams.

The diagonal axes of the yoke portion are generally set corresponding to a passing area of the electron beams.

However, distortions often occur in the actual passing area of the electron beams due to the accuracy of the deflection yoke and the like. Therefore, the diagonal axis of the yoke portion, in fact, has a directional deviation with respect to the passing area of the electron beams.

In the cathode ray tube having the above characteristic, if the curved portion formed at the diagonal portion of the yoke portion has arc shapes with substantially the same curvature radii at the major axis side and the minor axis side with respect to the diagonal axis as a reference, the electron beams with a maximum deflection angle will collide with a partially curved portion at any one side thereof. Therefore, a good image cannot be obtained.

In order to solve this problem, as shown in FIG. 8, a diagonal inner-face curved portion 8 and a diagonal outer-face curved portion 9 of a diagonal portion 7 are expanded by a single circular arc, while a constant distance between the diagonal portion 7 of the yoke portion 6 and the tube axis is maintained. However, the design and manufacture of a mold for the funnel, the design and manufacture for the deflection yoke, and a variety of other portions related to producing the cathode ray tube have to be completely changed. Thus, a lot of trouble or effort is caused and the cost becomes large.

Alternatively, to thin the thickness of the yoke portion entirely has also been considered. But, if the thickness is made too thin, there are problems in molding or strength, so that there is a limitation to thinning the thickness of the yoke portion and this strategy cannot be an effective solution.

SUMMARY OF THE INVENTION

According to the foregoing description, it is an object of the present invention to provide a funnel for a cathode ray tube, wherein by simply and effectively improving a diagonal portion of a yoke portion, it is not necessary to basically modify the mold or the deflection yoke, etc. and therefore, the electron beams can be suitably kept from colliding with the yoke portion, so as to be able to obtain a good image.

In order to achieve the object, the present invention provides a funnel for a cathode ray tube having a large opening portion with a substantially rectangular shape, a small opening portion with a substantially circular shape to which a cylindrical neck tube is connected, a funnel-shaped body portion continuous from the large opening portion, and a pyramid-shaped yoke portion continuous from the body portion to the small opening portion, comprising a diagonal inner-face curved portion is formed on an inner face of a diagonal portion of the yoke portion, wherein the diagonal inner-face curved portion comprises a partially inner-face curved portion at a major axis side and a partially inner-face curved portion at a minor axis side, both of which are imaginarily divided to each other with respect to a diagonal axis as a reference, and wherein at least one of the partially inner-face curved portions at the major axis side and the minor axis side swells to the outward side.

The term "swells to the outward side" means that at a cross-sectional plane perpendicular to the tube axis, at least one of the partially inner-face curved portions swells to the outward side (to the outer-face side of the yoke portion) than an imaginary extension line that extends along the inner face of the major side or the minor side, which form the yoke portion, toward the diagonal axis side. Therefore, when the inner faces of the minor side and the major side are respectively formed by circular arcs, the term "swells to the outward side" means that at least one of the partially inner-face curved portions swells to the outward side than an imaginary extension line of the circular arc. Moreover, in detail, the term "swells to the outward side" means that with respect to an imaginary reference curved line (a conventional curved line) whose curvature varies slowly from a central point of the inner face of at least one of the major axis side and the minor axis side toward the diagonal axis, the partially inner-face curved portion of at least one of the major axis side and the minor axis side swells to the outward side due to the changing of the curvature thereof greater than that of the imaginary reference curved line in the halfway of the imaginary reference curved line. In addition, when one of the partially inner-face curved portions of the major axis side and the minor axis side swells to the outward side, the one partially inner-face curved portion swells to the outward side relative to the other partially inner-face curved portion.

According to the above structure, for the diagonal inner-face curved portion formed on the inner face of the diagonal portion of the yoke portion, because both of or any one of the partially inner-face curved portions of the major axis side and the minor axis side swell (or swells) to the outward side, even though the electron beams with a maximum deflection angle may collide with one of the partially inner-face curved portions due to the diagonal axis of the yoke portion creating a directional deviation with respect to the actual passing area of the electron beams, the partially inner-face curved portion that swells to the outward side can serve as a passage through which the electron beams can pass. Therefore, the electron beams can be avoided from colliding with the curved portion formed on the diagonal portion of the yoke portion, so that a good image can be obtained. Furthermore, because the curved portion formed on the inner face of the diagonal portion of the yoke portion is not entirely expanded, but only a portion is swelled to the outward side with making a cross position between the diagonal axis and the curved portion almost unchangeable, design and manufacture of the mold for the funnel or the deflection yoke etc. are not greatly affected. Thus, collision of the electron beams can be avoided with only a minimum modification, and therefore, trouble, effort, and cost burden required for the modification can be further reduced.

It is preferred that the partially inner-face curved portions at the major axis side and the partially inner-face curved portion at the minor axis side are formed by circular arced portions with different radius to each other. In this situation, the circular arced portion with a smaller radius may be swelled to the outward side than the circular arced portion with a larger radius, or the circular arced portion with a larger radius may be swelled to the outward side than the circular arced portion with a smaller radius. In addition, the circular arced portion at the major axis side and the circular arced portion at the minor axis side may be jointed on the diagonal axis, or on a position other than the diagonal axis. Furthermore, each of the circular arced portions at the major axis side and the minor axis side may be drawn by single circular arc respectively, or may be drawn by jointing a plurality of circular arcs respectively. According to this structure, because one of the partially inner-face curved portions swells relatively to the outward due to the difference between the radii of the circular arced portions at the major axis side and the minor axis side, the design and manufacture of the curved portion can be easily performed and the rising of the manufacturing cost can be suppressed. The "jointing" between the circular arced portion at the major axis side and the circular arced portion at the minor axis side means to inscribe or to substantially inscribe. For substantially inscribing the circular arced portions, it is necessary to smoothly connect the bending point between the circular arcs (following description is the same).

Preferably, the central point of one circular arced portion, the central point of the other circular arced portion, and the jointing point of the circular arced portions are set on or in the vicinity of a single straight line. Namely, in a case that the radii of the one circular arced portion and the other circular arced portion are different to each other, when the central points of the circular arced portions and the jointing point therebetween are set on the straight line, although the curvature radii of the circular arced portions are different to each other, the tangent line at the jointing point between the circular arced portions is perpendicular to the straight line, so that the jointing portion between the circular arced portions is not bending, but smoothly continued. Therefore, when the central points of the circular arced portions and the jointing point between the circular arced portions are set on or in the vicinity of the straight line, the jointing portion between the circular arced portions can be avoided from being too bending and the moldability for the jointing portion can be well maintained.

The above-mentioned invention relates to the inner face of the diagonal portion of the yoke portion. However, it is preferable that the same structure may be applied to an outer face of the diagonal portion of the yoke portion. Namely, a diagonal outer-face curved portion is formed on the outer face of the diagonal portion of the yoke portion, wherein the diagonal outer-face curved portion comprises a partially outer-face curved portion at the major axis side and a partially outer-face curved portion at the minor axis side, both of which are imaginarily divided to each other with respect to the diagonal axis as a reference. At least one of the partially outer-face curved portions at the major axis side and the minor axis side swells to the outward side. Also, in this situation, the term "swells to the outward side" means that at a cross-sectional plane perpendicular to the tube axis, at least one of the partially outer-face curved portions swells to the outward side than an imaginary extension line that extends along the outer face of the major side or the minor side, which form the yoke portion, toward the diagonal axis side. Therefore, when the outer faces of the minor side and the major side are respectively formed by circular arcs, the term "swells to the outward side" means that at least one of the partially outer-face curved portions swells to the outward side than an imaginary extension line of the circular arc. Moreover, in detail, the term "swells to the outward side" means that with respect to an imaginary reference curved line (a conventional curved line) whose curvature varies slowly from a central point of the outer face of at least one of the major axis side and the minor axis side toward the diagonal axis, the partially outer-face curved portion of at least one of the major axis side and the minor axis side swells to the outward side due to the changing of the curvature thereof greater than that of the imaginary reference curved line in the halfway of the imaginary reference curved line. According to such structure, because the inner face of the diagonal portion of the yoke portion is partially swelled to the outward side and at the same time the outer face of the diagonal portion is also partially swelled to the outward side, the thickness of the entire diagonal portion is sufficient. As a result, although the partially swelling portion is formed, the entire rigidity of the diagonal portion can be set within a proper range.

In this situation, only one of the partially inner-face curved portions and only one of the partially outer-face curved portions at the major axis side and the minor axis side may be swelled to the outward side. According to the structure, the thickness of the portion that swells and the portion that does not swell at the diagonal portion is uniformized, so that the strength is not partially reduced and a good moldability can be maintained.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

Figure 1:
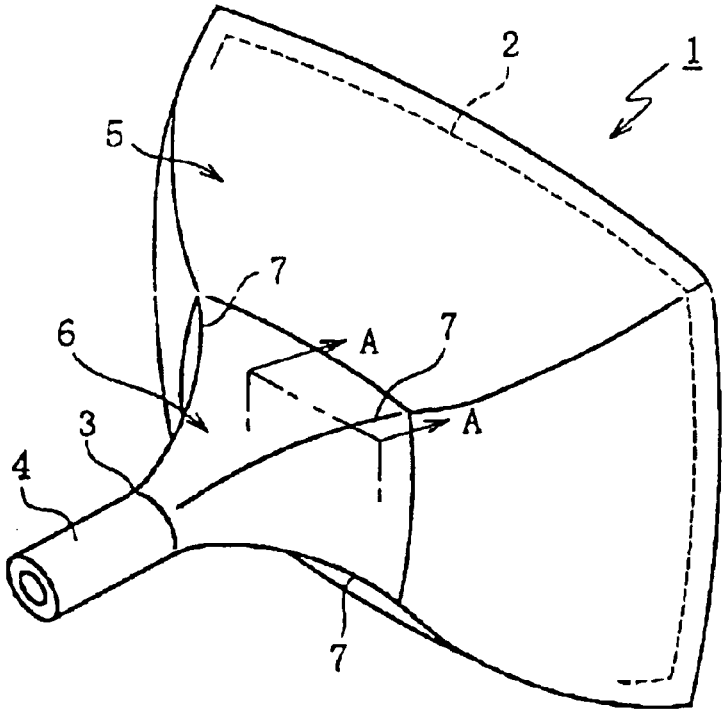
FIG. 1 is a perspective view showing a whole structure of a funnel for cathode ray tube, which is common for the first to the fourth embodiments of the present invention.

Embodiments according to the present invention are described in detail accompanying with attached drawings. FIG. 1 shows a funnel for cathode ray tube 1 according to the embodiment of the present invention. As shown in FIG. 1, the funnel for cathode ray tube 1 comprises a large opening portion with a substantially rectangular shape for sealing to a panel for a cathode ray tube (not shown), and a small opening portion 3 with a substantially circular shape for sealing to a substantially cylindrical neck tube 4. A yoke portion 6 for mounting a deflection yoke externally thereon is formed to be continuous to a substantially funnel-shaped body portion 5 at the side of the small opening portion 3. The internal space of the yoke portion 6 serves as a passage for electron beams. The yoke portion 6 is formed with a pyramid shape that changes gradually from a circular shape to a substantially rectangular shape from the side of the neck tube 4 to the side of the body portion 5.

Figure 2:
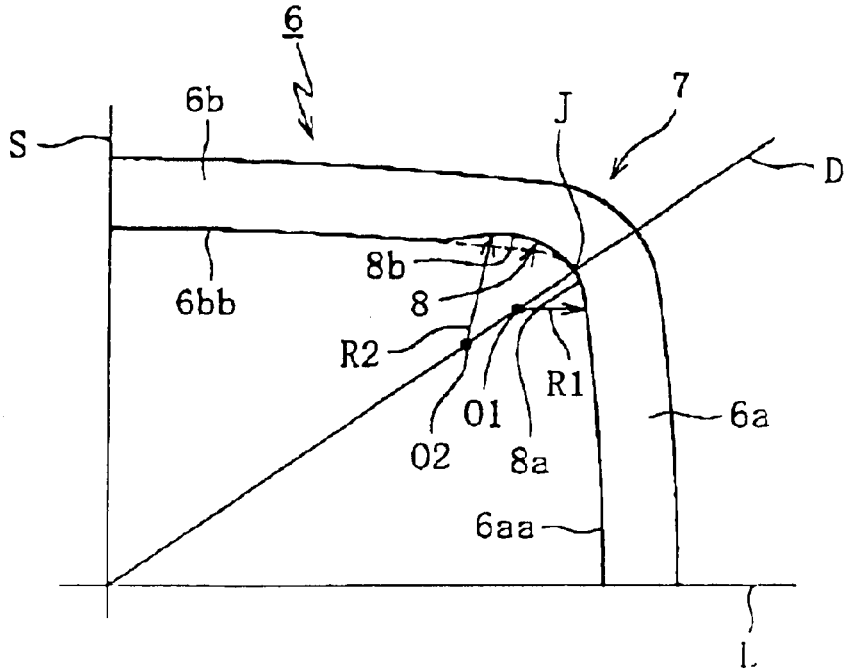
FIG. 2 shows major portions of the funnel for cathode ray tube according to the first embodiment of the present invention, and is an enlarged vertical and cross-sectional back view that is cut along the line A—A in FIG. 1.

FIG. 2 shows the first embodiment of the present invention, and is a vertical cross-sectional back view that cuts the ends of the yoke portion 6 at the side of the body portion 5 along the A—A line in FIG. 1. As shown in FIG. 2, a diagonal inner-face curved portion 8 is formed on the inner face of the diagonal portion 7 of the yoke portion 6. Additionally, with respect to a diagonal axis D as a reference, the diagonal inner-face curved portion 8 is imaginarily divided into a partially inner-face curved portion 8*a* (hereinafter, first curved portion) at the side of a minor side 6*a*, i.e., at the side of a major axis L, and a partially inner-face curved portion 8*b* (hereinafter, second curved portion) at the side of a major side 6*b*, i.e., at the side of a minor axis S.

The second curved portion 8*b* swells to the outward side than an imaginary extension line (the dash line in FIG. 2) of the inner face 6*bb* of the major side 6*b* toward the diagonal axis D. The first curved portion 8*a* does not swell to the outward side than an imaginary extension line of the inner face 6*aa* of the minor side 6*a* toward the diagonal axis D. In detail, referring to FIG. 3, with respect to the imaginary extension line 6*bx* as a reference wherein the inner face 6*bb* of the major side 6*b* extends toward the diagonal axis D while maintaining a curvature thereof, the second curved portion 8*b* swells to the outward side. The imaginary extension line 6*bx* is inscribed with a circular arc Dx that forms the conventional diagonal inner-face curved portion. Therefore, the curved line from the imaginary extension line 6*bx* to the circular arc Dx corresponds to an inner-face shape of the conventional major side 6*b*. In other words, with respect to the imaginary reference curved line (the conventional curved line) whose curvature changes slowly from a central portion of the inner face 6*bb* of the major side 6*b* toward the diagonal axis D, the second curved portion 8*b* swells to the outward side due to the changing of the curvature thereof greater than that of the imaginary reference line at the halfway of the imaginary reference line. In contrast, with respect to an imaginary extension line 6*ax* as a reference wherein the inner face 6*aa* of the minor side 6*a* extends toward the diagonal axis D while maintaining a curvature thereof, the first curved portion 8*a* does not swell to the outward side. Namely, the first curved portion 8*a* is formed along the imaginary reference curved line (the conventional curved line) whose curvature changes slowly from a central portion of the inner face 6*aa* of the minor side 6*a* toward the diagonal axis D. In addition, in this embodiment, any of the inner faces 6*aa*, 6*bb* of the minor side 6*a* and the major side 6*b* is a single arc, and therefore, any of the imaginary extension lines 6*ax*, 6*bx* is an extension line of the arc.

Figure 3:
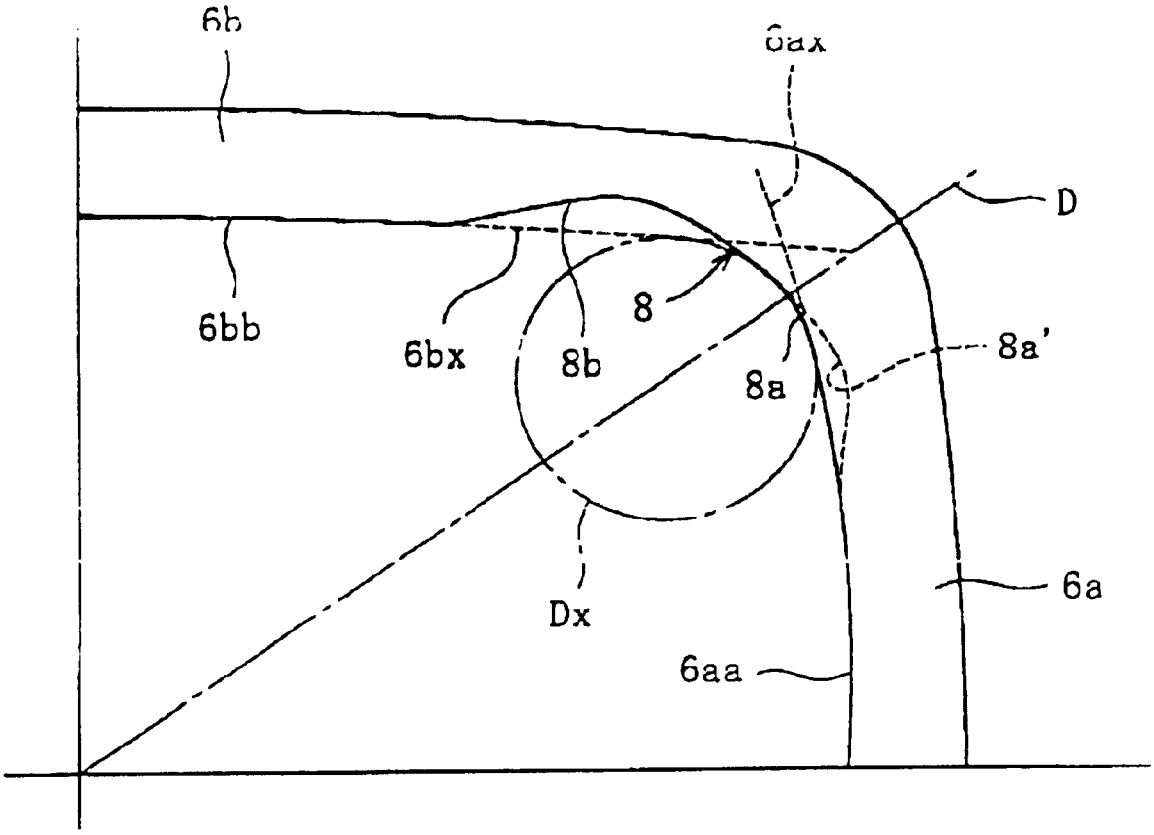
FIG. 3 shows major portions of the funnel for cathode ray tube according to the first embodiment of the present invention, and is an enlarged vertical and cross-sectional back view that is cut along the line A—A in FIG. 1.

According to the structure mentioned above, the internal area of the yoke portion 6 is partially enlarged by the amount of the swelling of the second curved portion 8*b* to the outward. In this situation, as shown in FIG. 2, the first curved portion 8*a* is a circular arced portion with a radius R1, and the second curved portion 8*b* is a circular arced portion with a radius R2 greater than R1. In this embodiment, since the jointing point J between the two circular arced portions and the central points O1, O2 of the two circular arced portions are set on the diagonal axis D, the jointing portion between the two circular arced portions is smoothly curved to be continuous to each other without bending. In addition, the jointing point J and the central points O1, O2 can be also set in the vicinity of the diagonal axis D. Alternatively, the jointing point J and the central points O1, O2 can be also set on or in the vicinity of a straight line other than the diagonal axis D. In another example, as shown in FIG. 3, in place of or together with the above structure, a first curved portion 8*a*', which swells to the outward side than the imaginary extension line 6*ax*, can be also formed on the inner face 6*aa* of the minor side 6*a*.

According to the above structure, although the electron beams pass through the internal of the yoke portion 6, the electron beams with a maximum deflection angle pass nearby the diagonal portion 7. In this situation, even though the electron beams with a maximum deflection angle may collide with the second curved portion 8*b* due to the diagonal axis D of the yoke portion 6 creating a directional deviation with respect to the actual passing area of the electron beams, the electron beams can still pass the swelled portion as a passage, because the second curved portion 8*b* swells to the outward side. Therefore, the electron beams can avoid colliding with the diagonal inner-face curved portion 8 of the yoke portion 6, so that a good image can be obtained.

Figure 8:
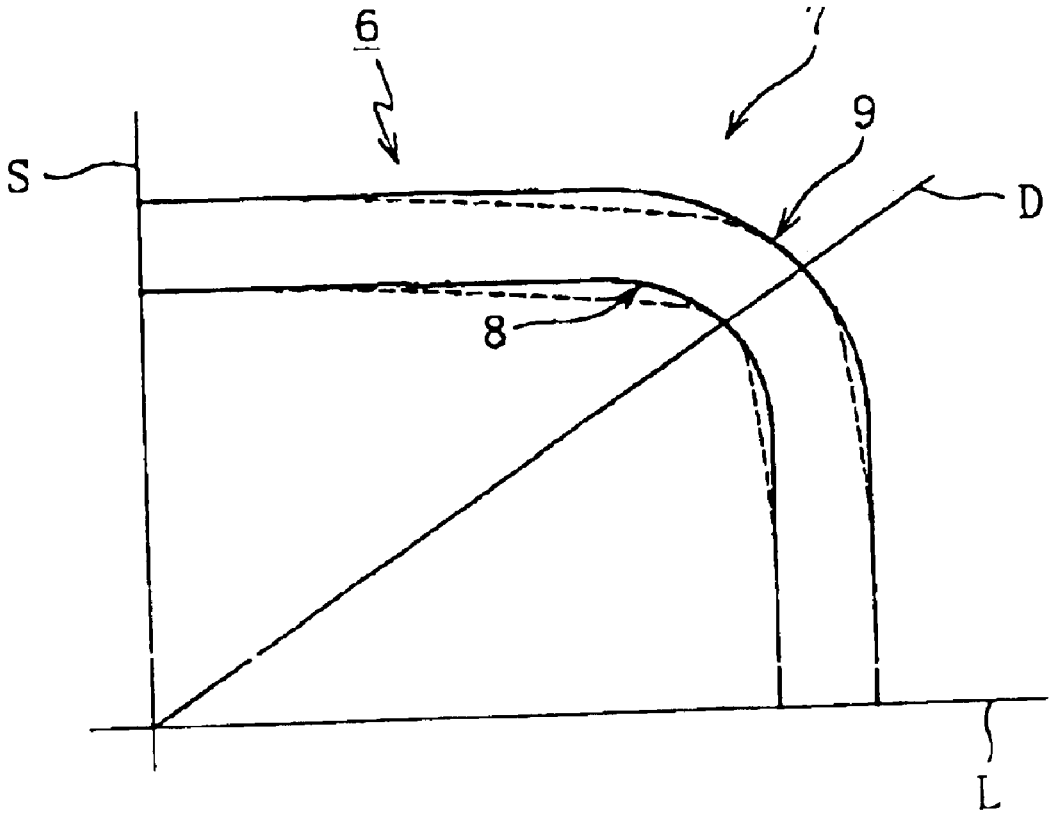
Fig. 8 (PRIOR ART)
FIG. 8 is an enlarged vertical and cross-sectional back view of major portions according to the conventional example (prior art example).

Furthermore, only the second curved portion 8*b* is swelled to the outward side without changing the crossing position between the diagonal inner-face curved portion 8 and the diagonal axis D from the conventional one. Therefore, compared with the conventional structure in FIG. 8 where the diagonal inner-face curved portion 8 is expanded entirely with the single circular arc from the dash line status to the solid line status, design and manufacture of the mold for the funnel do not need to be greatly changed, and the collision of the electron beams can be avoided by making only minimum changes.

Figure 4:
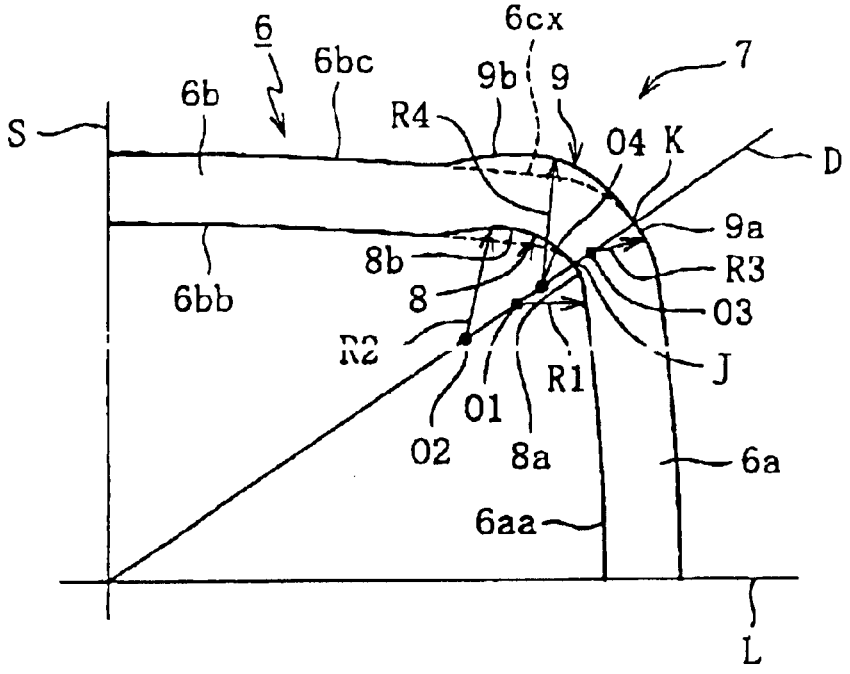
FIG. 4 shows major portions of the funnel for cathode ray tube according to the second embodiment of the present invention, and is an enlarged vertical and cross-sectional back view that is cut along the line A—A in FIG. 1.

FIG. 4 shows the second embodiment according to the present invention, and is a vertically cross-sectional back view that cuts the end portion of the yoke portion 6 at the side of the large opening portion 2 along the A—A line in FIG. 1. As shown in FIG. 4, the differences of the second embodiment from the first embodiment are as follows. In addition to the diagonal inner-face curved portion 8 formed on the inner face of the diagonal portion 7 of the yoke 6, for a diagonal outer-face curved portion 9 formed on an outer face of the diagonal portion 7 of the yoke portion 6, a partially outer-face curved portion (hereinafter, a third curved portion) 9*a* at the side of the major axis L of the diagonal axis D does not swell to the outward side, and a partially outer-face curved portion (hereinafter, a fourth curved portion) 9*b* at the side of the minor axis S swells to the outward than an imaginary extension line 6*cx* of an outer face 6*bc* of the major side 6*b* toward the diagonal axis D side. The imaginary extension line 6*cx* is a curved line (an arc in the embodiment) wherein the outer face 6*cc* of the major side 6*b* extends toward the diagonal axis D while maintaining a curvature thereof.

The jointing point K between the circular arced portion with a radius R3 that forms the third curved portion 9*a* and the circular arced portion with a radius R4 greater than R3 that forms the fourth curved portion 9*b*, and the central points O3, O4 of the two circular arced portions are set on the diagonal axis D. In this situation, the jointing point J and the central points O1, O2 at the side of the inner-face of the diagonal portion 7, and the jointing point K and the central points O3, O4 at the side of the outer-face of the diagonal portion 7 do not need to be set on the same straight line. The jointing point J and the central points O1, O2 may be set on or in the vicinity of a straight line, while the jointing point K and the central points O3, O4 may be set on or in the vicinity of another straight line. In addition, when a deflection yoke is mounted on an outer face of the conventional yoke portion 6 illustrated by the dash line in FIG. 4, the fourth curved portion 9*b* is swelled to the outward side into a gap defined between the inner face of the deflection yoke and the outer face of the yoke portion 6. Therefore, a conventional deflection yoke can be still used.

According to the second embodiment, in addition to being able to achieve the same effect as the first embodiment, the thickness of the fourth curved portion 9*b* that swells relatively to the outward side and the third curved portion 9*a* that does not swell are uniformized, so that the strength is not partially reduced and a good moldability can be maintained. Moreover, compared with the conventional structure in FIG. 8 wherein the diagonal inner-face curved portion 8 and the diagonal outer-face curved portion 9 are expanded entirely with a single circular arc from the dash line status to the solid line status, design and manufacture of the mold for the funnel or the deflection yoke do not need to be greatly changed, and the collision of the electron beams can be avoided by making only minimum changes. In addition, in place of the structure shown in FIG. 4, the fourth curved portion 9*b* may be made with a shape illustrated by the dash line without swelling to the outward side, while the third curved portion 9*a* may be swelled to the outward side than the imaginary extension line of the outer face of the minor side 6*b* obtained as mentioned above. In the above situation, although there is a little obstruction to uniformize the thickness, the entire material amount of the diagonal portion 7 does not change, so that the entire rigidity of the diagonal portion 7 can be properly maintained. Additionally, if necessary, both the third curved portion 9*a* and the fourth curved portion 9*b* may be swelled to the outward.

Figure 5:
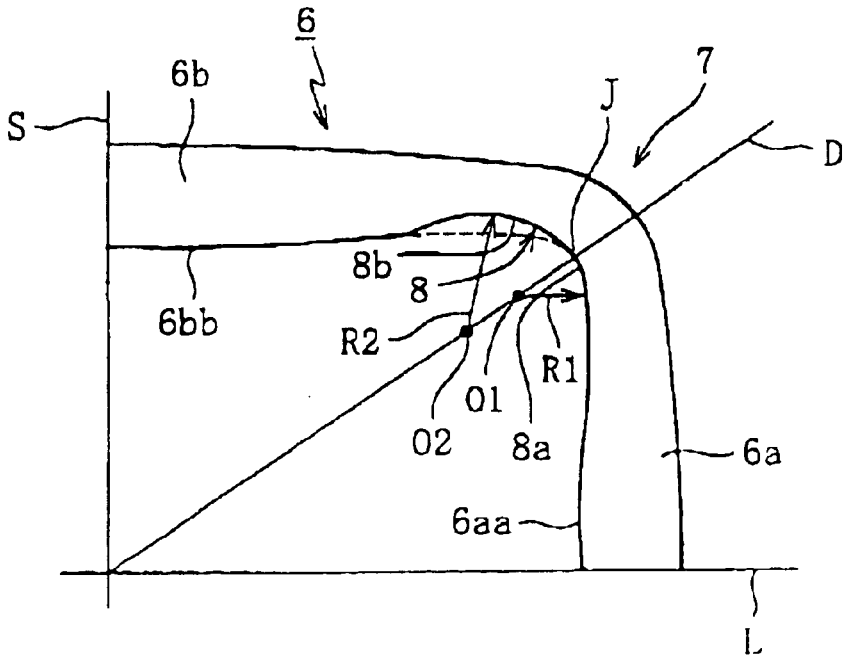
FIG. 5 shows major portions of the funnel for cathode ray tube according to the third embodiment of the present invention, and is an enlarged vertical and cross-sectional back view that is cut along the line A—A in FIG. 1.

FIG. 5 shows the third embodiment according to the present invention, and is a vertically cross-sectional back view that cuts the end portion of the yoke portion 6 at the side of the large opening portion 2 along the A—A line in FIG. 1. In the third embodiment, the structure of the diagonal inner-face curved portion 8 of the first embodiment is applied to the diagonal portion 7 of the yoke portion 6 wherein respective central portions of the inner faces 6*aa*, 6*bb* of the minor side 6*a* and the major side 6*b* swell to the inward side. Therefore, for the yoke portion 6 shown in FIG. 5, constituting portions that are common in the yoke portion 6 shown in FIG. 2 are labeled with the same reference numbers and their corresponding descriptions are omitted.

Figure 6:
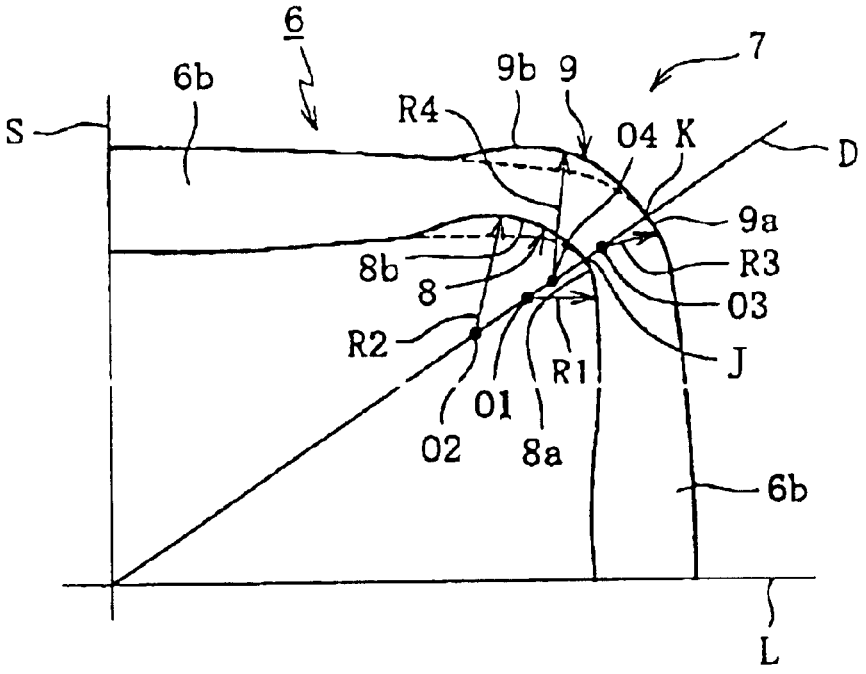
FIG. 6 shows major portions of the funnel for cathode ray tube according to the fourth embodiment of the present invention, and is an enlarged vertical and cross-sectional back view that is cut along the line A—A in FIG. 1.

FIG. 6 shows the fourth embodiment according to the present invention, and is a vertically cross-sectional back view that cuts the end portion of the yoke portion 6 at the side of the large opening portion 2 along the A—A line in FIG. 1. In the fourth embodiment, the structure of the diagonal inner-face curved portion 8 and the diagonal outer-face curved portion 9 of the second embodiment is applied to the diagonal portion 7 of the yoke portion 6 wherein respective central portions of the inner faces 6*aa*, 6*bb* of the minor side 6*a* and the major side 6*b* swell to the inward side. Therefore, for the yoke portion 6 shown in FIG. 6, constituting portions that are common in the yoke portion 6 shown in FIG. 3 are labeled with the same numbers and their corresponding descriptions are omitted.

In the first to fourth embodiments described above, for both the diagonal inner-face curved portion 8 and the diagonal outer-face curved portion 9, the circular arced portion with the greater radius is swelled to the outward than the circular arced portion with the smaller radius. However, in contrast, the circular arced portion with the smaller radius may be swelled to the outward than the circular arced portion with the greater radius.

In addition, the diagonal inner-face curved portion 8 and the diagonal outer-face curved portion 9 shown in the first to the fourth embodiments may be symmetrically formed on the diagonal portions 7 of all four corners of the yoke portion 6 with respect to the central axis (tube axis), or may be asymmetrically formed. Alternatively, the diagonal inner-face curved portion 8 and the diagonal outer-face curved portion 9 may be formed on only one diagonal portion, or on only two or three diagonal portions.

Next, a funnel for cathode ray tube according to the present invention is further described in detail in the following embodiment. The funnel is 66 cm in size, and has an aspect ratio of 16:9, a deflection angle of 104°, and an outer diameter of the neck is 29.1 mm.

Figure 7:
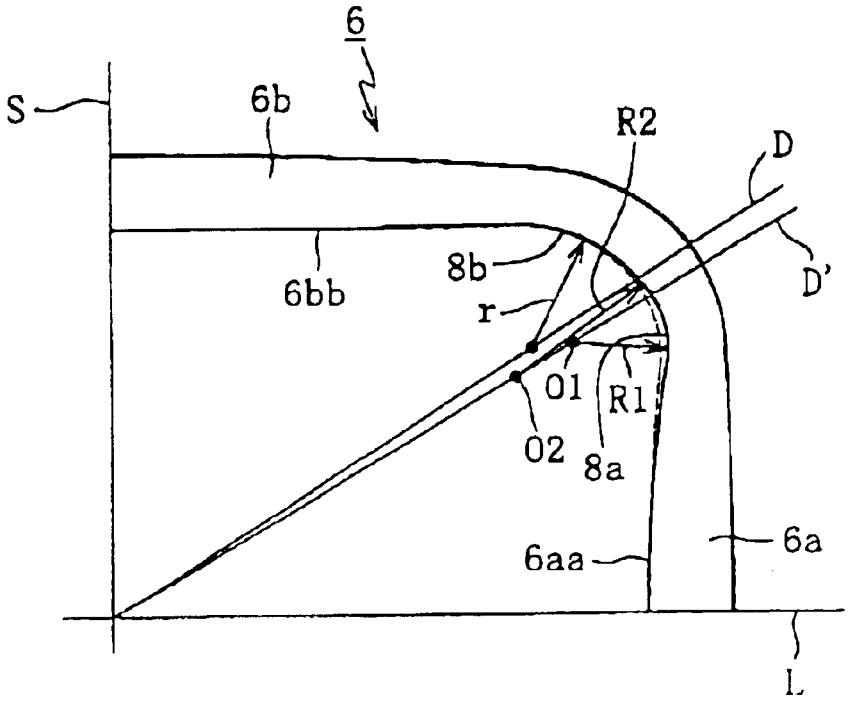
FIG. 7 shows major portions of the funnel for cathode ray tube according to the embodiment of the present invention, and is an enlarged vertical and cross-sectional back view that is cut along the line A—A in FIG. 1.

FIG. 7 shows the yoke portion of the funnel according to the embodiment, and is a vertically cross-sectional back view cut along the line A—A in FIG. 1. In the embodiment, at the yoke portion 6 wherein the respective central portions of the inner faces 6*aa*, 6*bb* of the minor side 6*a* and the major side 6*b* swell to the inward, as similar to the third embodiment, such a phenomenon that the electron beams collides with the inner wall of the yoke portion 6 due to the actual electron beams deviating from the diagonal axis D to the major axis L of the yoke portion 6 can be avoided, by forming the first curved portion 8*a* at the side of the minor side 6*a*.

In FIG. 7, the solid lines represent profile shapes of the inner face and the outer face of the yoke portion 6 of this embodiment, and the dash line represents a profile shape of the inner face of the conventional yoke portion. For example, at a cross-sectional plane perpendicular to the tube axis at a position that shifts in amount of 60 mm from the position of the substantially small opening portion 3 toward the body portion 5 of the funnel 1, the radius r (the radius of the circular arc represented by the dash line) of the conventional profile shape of the inner face is 13.3 mm, while the radius R2 of the second curved portion 8*b* is 16.3 mm and the radius R1 of the first curved portion 8*a* is 9.8 mm. In addition, under a condition that the center O1 of the first curved portion 8*a* and the center of the second curved portion 8*b* are set on a diagonal axis D' that shifts from the conventional diagonal axis D toward the major axis L, the jointing portion between the curved portions 8*a*, 8*b* is smoothly curved to be continuous to each other without bending.

The following Table 1 relates to the profile shape of the inner face at the cross-sectional plane perpendicular to the tube axis at the position that shifts in amount of 60 mm from the position of the substantially small opening portion 3 toward the body portion 5 of the funnel 1, as mentioned above. The distance from the central axis (the tube axis) of the funnel 1 is separated into the conventional profile shape (represented by $P_d$ in Table 1) and the profile shape of the embodiment (represented by $P_P$ in Table 1), and then compared with each other. Additionally, the Table 1 represent distances (mm) from the central axis, which are calculated per 10° (per 2° in the halfway) around the central axis from the major axis L to the minor axis S.

TABLE I

| angle (°) | major axis (L) | 10 | 20 | 22 | 24 | 26 | 28 | 30 | 32 | diagonal axis (D) | 40 | 50 | 60 | 70 | 80 | minor axis (S) |
|---|---|---|---|---|---|---|---|---|---|---|---|---|---|---|---|---|
| Conventional ($P_o$) | 53.8 | 54.8 | 58.0 | 59.0 | 60.1 | 61.3 | 62.4 | 63.2 | 63.6 | 63.8 | 62.4 | 54.3 | 48.1 | 44.4 | 42.4 | 41.7 |
| embodiment ($P_p$) | 53.8 | 54.9 | 58.4 | 59.5 | 60.7 | 62.1 | 63.4 | 64.0 | 64.3 | 64.1 | 62.4 | 54.4 | 48.2 | 44.4 | 42.4 | 41.7 |
| difference | 0.0 | 0.1 | 0.4 | 0.5 | 0.6 | 0.8 | 1.0 | 0.8 | 0.7 | 0.3 | 0.0 | 0.1 | 0.1 | 0.0 | 0.0 | 0.0 |

As can be apparent from the above Table 1, in comparison with the conventional shape of the inner-face profile, in the shape of the inner-face profile according to this embodiment, the first curved portion 8*a* with a maximum difference (1.0 mm) is formed at a position of 28° at the side of the major axis L from the diagonal axis D, while substantially the same shape with substantially no difference can be formed at the side of the minor axis S from the diagonal axis D.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. A funnel for cathode ray tube, having a large opening portion with a substantially rectangular shape, a small opening portion with a substantially circular shape to which a cylindrical neck tube is connected, a funnel-shaped body portion continuous from the large opening portion, and a pyramid-shaped yoke portion continuous from the body portion to the small opening portion, comprising:

a diagonal inner-face curved portion, being formed on an inner face of a diagonal portion of the yoke portion, wherein the diagonal inner-face curved portion comprises a partially inner-face curved portion at a side of a major axis and a partially inner-face curved portion at a side of a minor axis, both of which are imaginarily divided to each other with respect to a diagonal axis as a reference; and wherein at least one of the partially inner-face curved portions at the side of the major axis and the side of the minor axis swells to the outward side than an imaginary extension line that extends along an inner face of a major side or a minor side.

2. The funnel for cathode ray tube according to claim 1, wherein the partially inner-face curved portion of the diagonal inner-face curved portion at the side of the major axis and the partially inner-face curved portion of the diagonal inner-face curved portion at the side of the minor axis side are formed by circular arced portions with different radii to each other.

3. The funnel for cathode ray tube according to claim 2, wherein, a central point of one of the circular arced portions, a central point of the other of the circular arced portions, and a jointing point between the circular arced portions are set on a straight line, or in the vicinity of the straight line.

4. The funnel for cathode ray tube according to claim 1, further comprising a diagonal outer-face curved portion, being formed on an outer face of the diagonal portion of the yoke portion, wherein the diagonal outer-face curved portion comprises a partially outer-face curved portion at the side of the major axis and a partially outer-face curved portion at the side of the minor axis, both of which are imaginarily divided to each other with respect to the diagonal axis as a reference, and wherein at least one of the partially outer-face curved portions at the side of the major axis and the side of the minor axis swells to the outward side than the imaginary extension line that extends along an outer face of the major side or the minor side.

5. The funnel for cathode ray tube according to claim 4, wherein one of the partially inner-face curved portions swells to the outside than the imaginary extension line that extends along the inner face of the major side or the minor side and one of the partially outer-face curved portions swell to the outward side than the imaginary extension line that extends along the outer face of the major side or the minor side.

6. A funnel for cathode ray tube, having a large opening portion with a substantially rectangular shape, a small opening portion with a substantially circular shape to which a cylindrical neck tube is connected, a funnel-shaped body portion continuous from the large opening portion, and a pyramid-shaped yoke portion continuous from the body portion to the small opening portion, comprising:

a diagonal inner-face curved portion, being formed on an inner face of a diagonal portion of the yoke portion, wherein the diagonal inner-face curved portion comprises a partially inner-face curved portion at a major axis side and a partially inner-face curved portion at a minor axis side, both of which are imaginarily divided to each other with respect to a diagonal axis as a reference;

wherein at least one of the partially inner-face curved portions at the major axis side and the minor axis side swells to the outward side;

wherein the partially inner-face curved portion at the major axis side and the partially inner-face curved portion at the minor axis side are formed by circular arced portions with different radii to each other;

wherein a central point of one of the circular arced portions, a central point of the other of the circular arced portions, and a jointing point between the circular arced portions are set on a straight line, or in the vicinity of the straight line.

7. A funnel for cathode ray tube, having a large opening portion with a substantially rectangular shape, a small opening portion with a substantially circular shape to which a cylindrical neck tube is connected, a funnel-shaped body portion continuous from the large opening portion, and a pyramid-shaped yoke portion continuous from the body portion to the small opening portion, comprising:

a diagonal inner-face curved portion, being formed on an inner face of a diagonal portion of the yoke portion, wherein the diagonal inner-face curved portion comprises a partially inner-face curved portion at a major axis side and a partially inner-face curved portion at a minor axis side, both of which are imaginarily divided to each other with respect to a diagonal axis as a reference, wherein at least one of the partially inner-face curved portions at the major axis side and the minor axis side swells to the outward side; and a diagonal outer-face curved portion, being formed on an outer face of the diagonal portion of the yoke portion, wherein the diagonal outer-face curved portion comprises a partially outer-face curved portion at the major axis side and a partially outer-face curved portion at the minor axis side, both of which are imaginarily divided to each other with respect to the diagonal axis as a reference, and wherein at least one of the partially outer-face curved portions at the major axis side and the minor axis side swells to the outward side.

8. The funnel for cathode ray tube according to claim 7, wherein one of the partially inner-face curved portions and one of the partially outer-face curved portions swell to the outward side.

* * * * *